US009057276B2

(12) United States Patent
Lee

(10) Patent No.: US 9,057,276 B2
(45) Date of Patent: Jun. 16, 2015

(54) TWISTED GAS TURBINE ENGINE AIRFOIL HAVING A TWISTED RIB

(71) Applicant: Ching-Pang Lee, Cincinnati, OH (US)

(72) Inventor: Ching-Pang Lee, Cincinnati, OH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 294 days.

(21) Appl. No.: 13/760,137

(22) Filed: Feb. 6, 2013

(65) Prior Publication Data

US 2014/0219811 A1 Aug. 7, 2014

(51) Int. Cl.
*F01D 5/14* (2006.01)
*F01D 5/18* (2006.01)

(52) U.S. Cl.
CPC ..... *F01D 5/141* (2013.01); *F01D 5/147* (2013.01); *F01D 5/187* (2013.01)

(58) Field of Classification Search
CPC ..... F01D 5/14; F01D 5/141; F01D 5/147; F01D 5/18; F05D 2250/291; F05D 2250/711; F05D 2250/712
USPC ..... 415/192; 416/223 A, 243, 226, 232, 416/233, 238
See application file for complete search history.

(56) References Cited

U.S. PATENT DOCUMENTS

| | | | | |
|---|---|---|---|---|
| 2,675,208 | A * | 4/1954 | Weinberg | 416/233 |
| 3,606,580 | A * | 9/1971 | Kaufman, Sr. | 416/232 |
| 4,501,053 | A | 2/1985 | Craig et al. | |
| 4,512,069 | A | 4/1985 | Hagemeister | |
| 4,738,587 | A * | 4/1988 | Kildea | 416/96 R |
| 4,815,939 | A | 3/1989 | Doble | |
| 5,269,058 | A | 12/1993 | Wiggs et al. | |
| 6,033,186 | A | 3/2000 | Schilling et al. | |
| 6,893,210 | B2 * | 5/2005 | Zhang et al. | 415/116 |
| 6,969,233 | B2 | 11/2005 | Powis et al. | |
| 7,334,333 | B2 | 2/2008 | Palazzini et al. | |
| 7,641,445 | B1 * | 1/2010 | Liang | 416/97 R |
| 7,686,578 | B2 | 3/2010 | Klasing et al. | |
| 7,938,624 | B2 | 5/2011 | Tibbott | |
| 8,052,378 | B2 | 11/2011 | Draper | |
| 8,083,484 | B2 | 12/2011 | Hatman | |
| 8,303,252 | B2 * | 11/2012 | Piggush | 416/97 R |
| 2005/0111977 | A1 * | 5/2005 | Lee et al. | 416/97 R |
| 2007/0286729 | A1 * | 12/2007 | Kopmels | 416/97 R |
| 2009/0165988 | A1 | 7/2009 | Rockstroh | |
| 2010/0098526 | A1 * | 4/2010 | Piggush | 415/115 |

FOREIGN PATENT DOCUMENTS

| | | | |
|---|---|---|---|
| GB | 2462087 | A | 1/2010 |

* cited by examiner

*Primary Examiner* — Edward Look
*Assistant Examiner* — Jesse Prager

(57) ABSTRACT

A gas turbine engine blade (20), including: an airfoil (24) including a pressure side exterior surface (34), a suction side exterior surface (36), and a first rib (130) spanning between the pressure side exterior surface and the suction side exterior surface. The airfoil (24) is twisted from a base end (30) of the airfoil to a tip end (32) of the airfoil. The first rib is twisted from a base end of the first rib to a tip end of the first rib. The pressure side exterior surface, the suction side exterior surface, and the first rib are cast as a monolith.

16 Claims, 6 Drawing Sheets

TWISTED GAS TURBINE ENGINE AIRFOIL HAVING A TWISTED RIB

FIELD OF THE INVENTION

The present invention relates to gas turbine engine blades having a twisted airfoil. In particular, the invention relates to a cast, monolithic and twisted airfoil having a twisted rib therein.

BACKGROUND OF THE INVENTION

Gas turbine engine blades have airfoils that may be hollow and may include reinforcing ribs. These ribs may structurally reinforce the blade from several forces, including aerodynamic forces that tend to bend the blade about a base of the blade in a cantilever fashion, forces that tend to balloon a skin of the airfoil caused by higher static pressure present inside the hollow airfoil, and centrifugal force due to rotation of the blade. In addition to adding structural strength, in certain designs these ribs help define cooling channels present in the hollow airfoil.

Airfoils for gas turbine engine blades may be manufactured in various ways. One common way used is a casting process, due to its relatively low cost. In this process a casting core is first made using a rigid master die set. In this process a first half and a second half of the die are assembled together and form a hollow interior void. A casting core material is put into the hollow interior void and solidifies. Once solidified, the first and second die halves are separated by pulling them apart from each other along a straight separation line. The die halves are rigid, and the casting core is rigid. Consequently, there can be no interference between the casting core and the die halves as they are separated. This has resulted in casting core designs where any features in the casting core must be designed to permit the separation. For example, voids in the casting core, used subsequently to form the reinforcing ribs in the airfoil, are formed such that they are parallel to the direction along which the die halves are pulled apart. This necessarily results in the subsequently formed ribs being parallel to each other.

Certain airfoil designs include a twist in the airfoil from a base of the airfoil radially outward toward a tip of the airfoil. For any given radial cross section of the airfoil, a chord line connecting a leading edge of the airfoil to the trailing edge forms a chord line. A radially inward projection of the chord line forms an angle with a longitudinal axis of a rotor shaft of the gas turbine engine. When the angle formed changes from one radial cross section to the next in an airfoil, the blade may be considered twisted. While a casting process is able to accommodate a twist of the outer surfaces of the airfoil, the ribs must remain parallel to each other and to the separation line. As a result, in different radial cross sections the ribs will remain parallel to each other and the separation line, but since the airfoil is twisting, the ribs will change their orientation with respect to a skin of the airfoil. In certain circumstances it is preferred that the rib remain in the same (or similar) orientation to the skin in each cross section, such as for optimum strength, or optimum cooling when the rib defines part of a cooling channel. In certain circumstances it is preferred that the ribs not be parallel. Hence, other manufacturing techniques have been explored.

FIG. 1 shows a prior art airfoil disclosed in U.S. Pat. No. 4,512,069 to Hagemeister. In this twisted airfoil the 10 a first rib 12 and a second rib 14 change orientation from a base cross section 16 to a tip cross section 18. This is accomplished by forging a worked conduit (drawn, swaged etc) into an untwisted airfoil shape and then twisting it. This working, forging, and twisting process is significantly different than casting, and may be more expensive.

A technique for forming ribs that are not parallel includes using two die halves and fugitive inserts. The fugitive inserts are positioned inside the hollow interior void, the casting material is placed in the hollow interior void, and the once the casting core is solidified the fugitive material is removed to form rib voids that are not parallel, and hence the subsequently formed ribs are not parallel.

However, these techniques may be costlier than simple casting, and hence there remains room in the art for improvement.

BRIEF DESCRIPTION OF THE DRAWINGS

The invention is explained in the following description in view of the drawings that show.

DETAILED DESCRIPTION OF THE INVENTION

The present inventor has developed a monolithic turbine engine blade made via a casting process that includes at least one twisted rib. Such a configuration allows for an orientation of the rib that is optimized for strength and/or efficient heat exchange.

Figure 1:
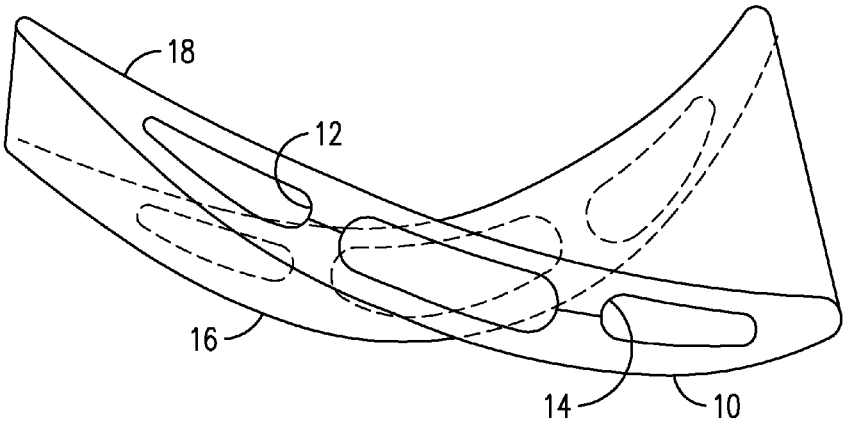
FIG. 1 PRIOR ART
FIG. 1 shows a prior art blade having a twisted web made via a forging process.
Figure 2:
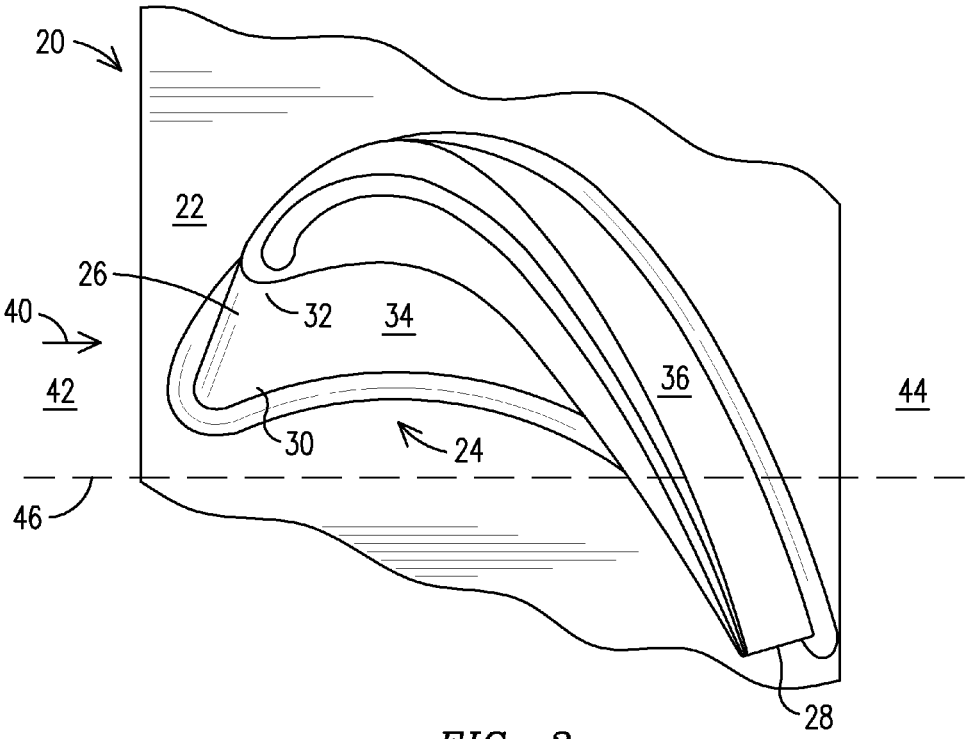
FIG. 2 shows a blade having a cast, monolithic, twisted airfoil.

FIG. 2 shows gas turbine engine blade 20 including a platform 22 and an airfoil 24. The airfoil 24 has a leading edge 26, a trailing edge 28, a base end 30, a tip end 32, a pressure side exterior surface 34, and a suction side exterior surface 36. Combustion gases 40 flowing from an upstream side 42 of the a gas turbine engine flow toward a downstream side 44 of the gas turbine engine while encountering the blade 20, and an interaction of the combustion gases 40 and the blade 20 causes the blade 20 to rotate about a longitudinal axis 46 of a rotor shaft (not shown) of the gas turbine engine. Discussion herein focuses on turbine blades, but the same concepts can be applied to compressor blades, turbine vanes, and compressor vanes.

Figure 5:
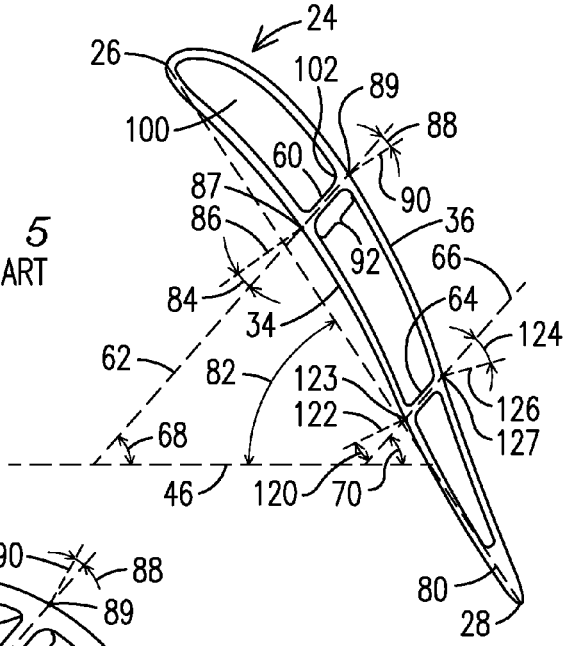
FIG. 5 PRIOR ART
FIGS. 3-5 show cross sections of a prior art twisted airfoil having planar (not twisted) webs.
Figure 4:
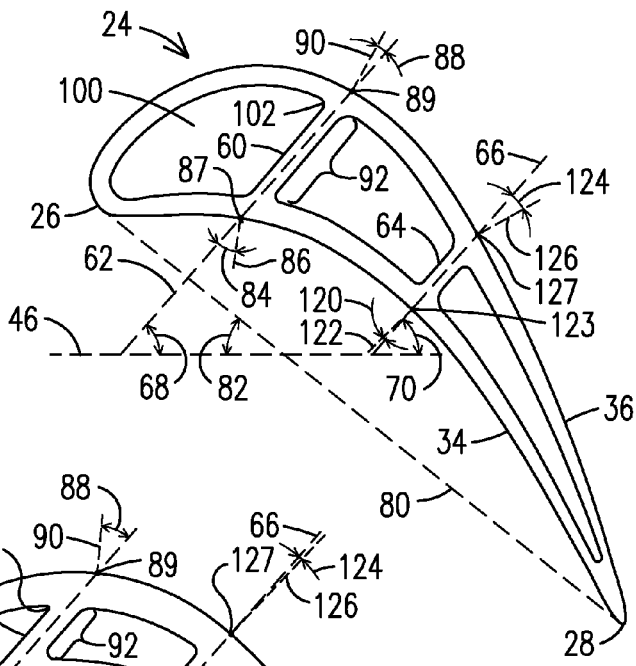
FIG. 4 PRIOR ART
Figure 3:
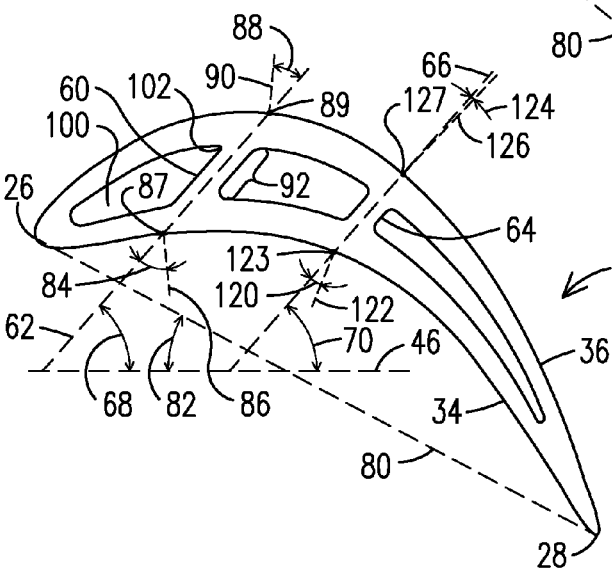
FIG. 3 PRIOR ART

FIGS. 3-5 show radial cross sections of a blade similar to that of FIG. 2. FIG. 3 shows a cross section at approximately 10% of the span from the base end 30 to the tip end 32. FIG. 4 shows a cross section at approximately 50% of the span. FIG. 5 shows a cross section at approximately 90% of the span. In each of these figures the airfoil 24 has a first rib 60 having a first longitudinal axis 62, and a second rib 64 having a second longitudinal axis 66. The first longitudinal axis 62 and the second longitudinal axis 66 both span from the pressure side exterior surface 34 to the suction side exterior surface 36, and are an elongated extend of the respective rib. In general, the longitudinal axes will bisect the ribs. A radially inward projection of the first longitudinal axis 62 will intersect the longitudinal axis 46 of a rotor shaft, or as shown in FIGS. 3-5, the first longitudinal axis 62 will intersect the longitudinal axis 46 of a rotor shaft to form a first angle 68 in each cross section. Similarly, a radially inward projection of the second longitudinal axis 66 will intersect the longitudinal axis 46 of a rotor shaft, or as shown in FIGS. 3-5, the second longitudinal axis 66 will intersect the longitudinal axis 46 of the rotor shaft to form a second angle 70 in each cross section. As shown in FIGS. 3-5, the first angle 68 remains the same in each figure. Similarly, the second angle 70 remains the same in FIGS. 3-5. In addition, the first longitudinal axis 62 and the second longitudinal axis 66 are parallel to each other.

In each cross section there is a chord line 80 and a radially inward projection of the chord line 80 will intersect the longitudinal axis 46 of a rotor shaft, or as shown in FIGS. 3-5, the chord line 80 will intersect the longitudinal axis 46 of a rotor shaft to form a chord line angle 82. In each of the three cross sections the chord line 80 twists, and as a result the chord line angle 82 changes. Consequently, in these figures it is apparent that while the airfoil 24 is twisted, the first rib 60 and the second rib 64 do not twist. This lack of twist may not be optimal in terms of structural strength and cooling.

In the prior art the first longitudinal axis 62 may form a first-axis-to-pressure-side-normal angle 84 with a line 86 normal to the pressure side exterior surface 34 and emanating from an intersection point 87 of the first longitudinal axis 62 and the pressure side exterior surface 34. It may also form a first-axis-to-suction-side-normal angle 88 with a line 90 normal to the suction side exterior surface 36 and emanating from an intersection point 89 of the first longitudinal axis 62 and suction side exterior surface 36.

The greater the angles 84, 88, the less effective the first rib 60 is at resisting aerodynamic forces that work to deflect the airfoil 24 in a cantilever manner about the platform 22, and ballooning forces that tend to deflect the suction side exterior surface 36 outward. Also, as the angles 84, 88 increase, a length 92 of the first rib 60 increases. This increased length adds weight, and this added weight increases centrifugal forces in the rotating blade 20. Further, in an exemplary embodiment where the first rib 60 helps to define a cooling channel 100, these angles 84, 88 create a skewing of a corner 102 of the cooling channel 100. Skewed corners are not optimum for cooling in that they create stagnant areas that interferes with cooling in other areas of the cooling channel 100.

Similar to the first longitudinal axis 62, the second longitudinal axis 66 may form a second-axis-to-pressure-side-normal angle 120 with a line 122 normal to the pressure side exterior surface 34 and emanating from an intersection point 123 of the second longitudinal axis 66 and the pressure side exterior surface 34. (Line 122 is shown as not exactly normal in the figure for sake of clarity of the drawing itself.) It may also form a second-axis-to-suction-side-normal angle 124 with a line 126 normal to the suction side exterior surface 36 and emanating from an intersection point 127 of the second longitudinal axis 66 and the suction side exterior surface 36. The greater the angles 120, 124 the greater the same problems are that are encountered with the angles 84, 88.

Figure 8:
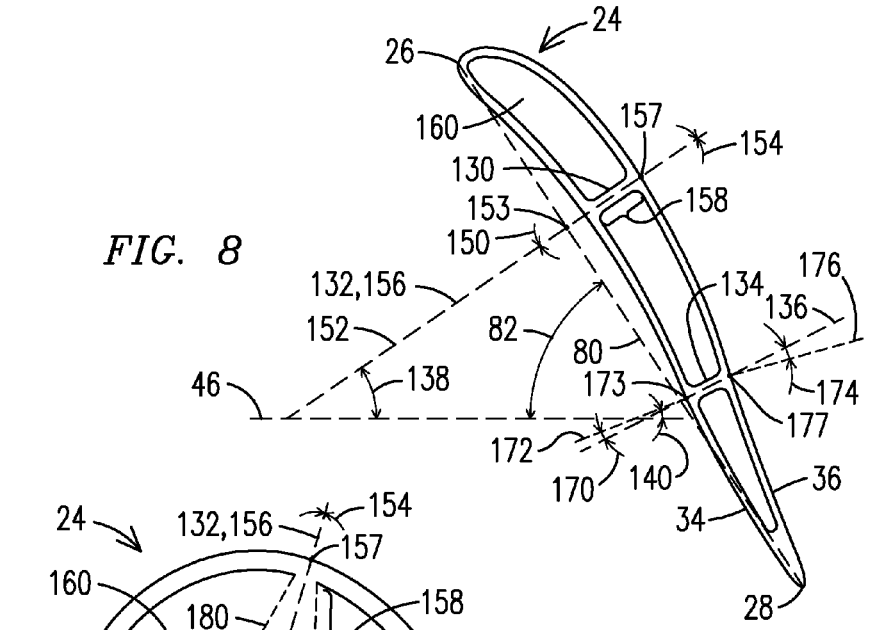
FIGS. 6-8 show cross sections of the twisted airfoil of FIG. 2.
Figure 7:
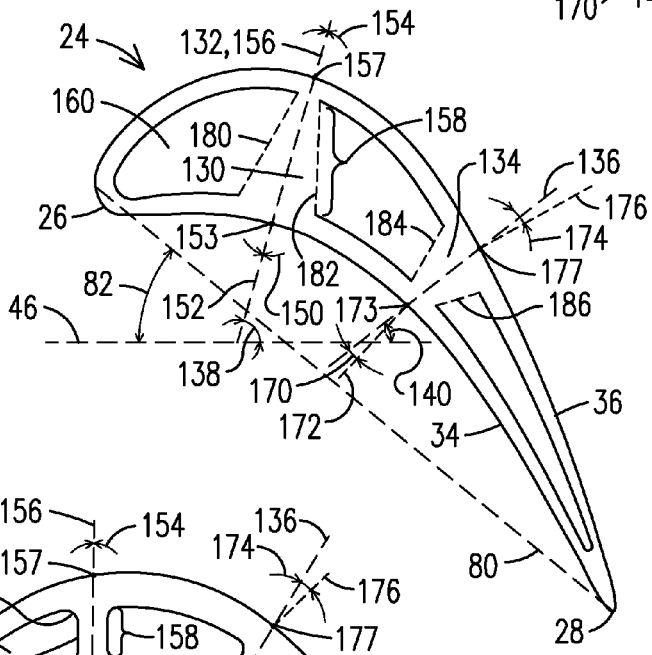
Figure 6:
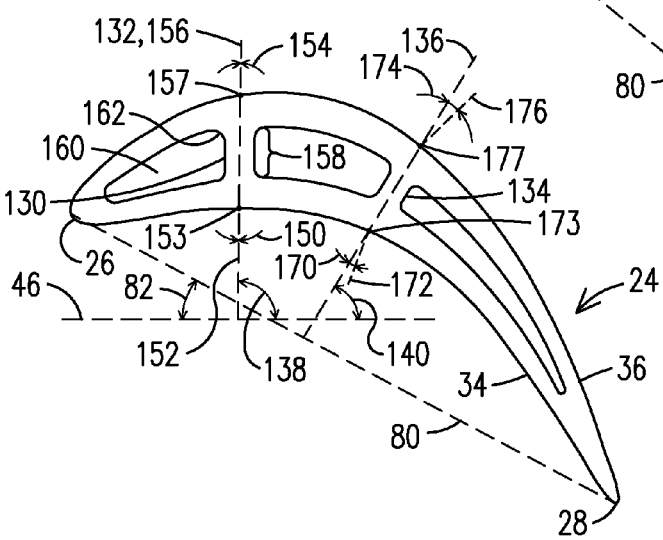

FIGS. 6-8 show radial cross sections of a blade similar to that of FIG. 2, but with the twisted ribs disclosed herein. FIG. 6 shows a cross section at approximately 10% of the span from the base end 30 to the tip end 32. FIG. 7 shows a cross section at approximately 50% of the span. FIG. 8 shows a cross section at approximately 90% of the span. In each cross section there is the chord line 80 and the chord line angle 82, and it can be seen that the chord line angle 82 changes in each cross section, meaning that the airfoil 24 is twisted. However, the twist may occur in fewer than every cross section. For example, the twist may only occur for a portion of a span of the airfoil 24, or may occur as a transition from a first untwisted portion of the span to a second untwisted portion of the span. Stated another way, the twist can be present in some or all of the span from the base end 30 to the tip end 32.

In each of these figures the airfoil 24 has a first rib 130 having a first longitudinal axis 132, and a second rib 134 having a second longitudinal axis 136. Similar to the prior art, a radially inward projection of the first longitudinal axis 132 will intersect the longitudinal axis 46 of the rotor shaft, or as shown in FIGS. 6-8, the first longitudinal axis 132 will intersect the longitudinal axis 46 of the rotor shaft to form a first angle 138 in each cross section. Similarly, a radially inward projection of the second longitudinal axis 136 will intersect the longitudinal axis 46 of the rotor shaft, or as shown in FIGS. 6-8, the second longitudinal axis 136 will intersect the longitudinal axis 46 of the rotor shaft to form a second angle 140 in each cross section. Unlike the prior art, as shown in FIGS. 6-8, the first angle 138 does not remain the same in each figure. Stated another way, the first longitudinal axis 132 in FIG. 6, which can be considered a first reference axis taken at a base end 30 of the airfoil 24, is not parallel to the first longitudinal axis 132 in FIG. 7 or in FIG. 8. Similarly, the second longitudinal axis 136 FIG. 6, which can be considered a second reference axis taken at a base end 30 of the airfoil 24, is not parallel to the second longitudinal axis 136 in FIG. 7 or in FIG. 8, the second angle 140 does not remain the same in FIGS. 6-8, and likewise, the second longitudinal axis 136 of FIG. 6 is not parallel to the second longitudinal axis 136 of FIG. 7 or 8. In addition, the first longitudinal axis 132 and the second longitudinal axis 136 are not necessarily parallel to each other. Thus, in this twisted airfoil 24, the first rib 130 and the second rib 134 are twisted as well. The twist may be smooth and continuous, or may be abrupt and discontinuous.

With the twisted ribs 130, 134 disclosed herein, the first longitudinal axis 132 may form a first-axis-to-pressure-side-normal angle 150 with a line 152 normal to the pressure side exterior surface 34 and emanating from an intersection point 153 of the first longitudinal axis 132 and the pressure side exterior surface 34. As shown, the first longitudinal axis 132 and the line 152 normal to the pressure side exterior surface 34 are parallel, and thus in the exemplary embodiment shown the first-axis-to-pressure-side-normal angle 150 is zero degrees. Stated another way, the first longitudinal axis 132 is normal/perpendicular to the pressure side exterior surface 34. Similarly, the first longitudinal axis 132 may form a first-axis-to-suction-side-normal angle 154 with a line 156 normal to the pressure side exterior surface 34 and emanating from an intersection point 157 of the first longitudinal axis 132 and the suction side exterior surface 36. A smaller angle 150, 154 means a length 158 of the first rib 130 is shorter. This reduces weight and centrifugal forces while providing increased strength.

As shown, the first longitudinal axis 132 and the line 156 normal to the pressure side exterior surface 34 are parallel, and thus in the exemplary embodiment shown the first-axis-to-suction-side-normal angle 154 is zero degrees. This may occur if the pressure side exterior surface 34 and the suction side exterior surface 36 are parallel to each other at those points. However, it is also possible that the pressure side exterior surface 34 and the suction side exterior surface 36 are not parallel to each other when they intersect the first longitudinal axis 132. In that case the first-axis-to-pressure-side-normal angle 150 and the first-axis-to-suction-side-normal angle 154 may not be the same. In any case, the angles 150, 154 are to be close to zero, plus or minus 10 degrees. When the angles 150, 154 are closer to perpendicular to the pressure side exterior surface 34 and suction side exterior surface 36 respectively this results in a greater resistance to aerodynamic forces that work to cantilever the airfoil 24 about the platform 22, and a greater resistance to ballooning forces that tend to balloon the suction side exterior surface 36 outward. In addition, in an exemplary embodiment where the first rib 130 helps to define a cooling channel 160, when the first longitudinal axis 132 is nearly normal to the pressure side exterior surface 34 and suction side exterior surface 36 there is less skew in the corners 162 of the cooling channel 160. This allows for more efficient cooling. Still further, the ability to control the angles 150, 154 allows designers to ensure robust support exist at locations where subsequent manufacturing steps require it. For example, in some instances snubbers may be joined to the airfoil 24 in a process whereby substantial force is imparted to the airfoil 24, such as by a friction welding process. The closer angles 150, 154 are to perpendicular, the greater the support they provide during the joining process.

Similar to the first longitudinal axis 132, the second longitudinal axis 136 may form a second-axis-to-pressure-side-normal angle 170 with a line 172 normal to the pressure side exterior surface 34 and emanating from an intersection point 173 of the second longitudinal axis 136 and the pressure side exterior surface 34. It may also form a second-axis-to-suction-side-normal angle 174 with a line 176 normal to the suction side exterior surface 36 and emanating from an intersection point 177 of the second longitudinal axis 136 and the suction side exterior surface 36. As with angles 150, 154, the smaller the angles 170, 174 the greater the resistance to aerodynamic forces that work to cantilever the airfoil 24 about the platform 24, the greater the resistance to the ballooning forces, the more efficient the cooling, and the greater design freedom for strength that may be needed during subsequent manufacturing etc. The twist of the first longitudinal axis 132 and the second longitudinal axis 136 may or may not follow the twist of the airfoil 24. For example, a rate of twist, which may be defined as a change in the chord line angle 82 for a given change in radial distance, from the base end 30 to the tip end 32, may be constant for the airfoil 24. If a rate of twist from the base end 30 to the tip end 32 of the rib is constant, then the twist of the rib may be considered to follow the twist of the airfoil 24. Alternately, the rate of twist of the airfoil may be greater than or less than the rate of twist of the fib. The rates may vary radially as well, such that the rate of twist of the airfoil 24 may, in one radial range, be greater than the rate of twist of the rib, and at another radial range the rate of twist of the airfoil 24 may be less than the rate of twist of the rib. Any combination of the above may be possible.

A further difference from the prior art is that the first rib 130 and the second rib 134 within any cross section may not be parallel to each other. This may be influenced by a profile of the airfoil 24, and not limitations of the core casting process. As a result, there may be cross sections where the first rib 130 and the second rib 134 are not parallel, and one or more cross sections where the first rib 130 and the second rib 134 are parallel to each other.

FIG. 7 shows an exemplary embodiment of the airfoil 24 where a first leading edge side 180 of the first rib 130 and a first trailing edge side 182 of the first rib 130 are not parallel to each other. Similarly, a second leading edge side 184 of the second rib 134 and a second trailing edge side 186 of the second rib 134 may not be parallel to each other. The sides may be symmetrically tapered as shown, in either direction, or may be asymmetric. The same manufacturing procedure that enables the formation of the twisted ribs enables the formation of ribs that would not be possible when the core is manufactured using the rigid die set. A longitudinal axis of a rib is that axis along which the rib offers the most structural rigidity. Consequently, when the rib is symmetric the axis typically bisects the cross section of the rib. When a rib is asymmetric, the longitudinal axis may have to be determined, but will still be the axis along which the rib offers the most resistance to the cantilevering and ballooning forces disclosed herein.

The monolithic airfoil 24 having the twisted ribs may be formed using a flexible silicone mold, such as in a technique developed by Mikro Systems, Inc. of Charlottesville, Va., and described in U.S. Pat. No. 8,062,023 issued Nov. 22, 2011 to Appleby et al., which is incorporated herein by reference. The core used may be thermally reshaped during its manufacture to reach its desired shape, as disclosed in U.S. patent application publication number 2011/0132562 to Merrill et al., published Jun. 19, 2011 and incorporated herein by reference. In this process, prior to full curing the core can be heated to beyond the epoxy reversion temperature, bent into a new shape, such as by pressing it into a fixture, and either cooled to below the reversion temperature, or heated until it reaches a cured state. Alternately, the monolithic airfoil 24 may be cast using a fugitive core die, where the fugitive material itself has a twist to it, which in turn leaves a twisted void for the rib in the casting core. The monolithic airfoil 24 may further be manufactured using a core that becomes an integral core once multiple core components have been assembled together. Any feature disclosed herein regarding the twisted ribs may be formed by creating an associated feature in the casting core disclosed herein.

Figure 9:
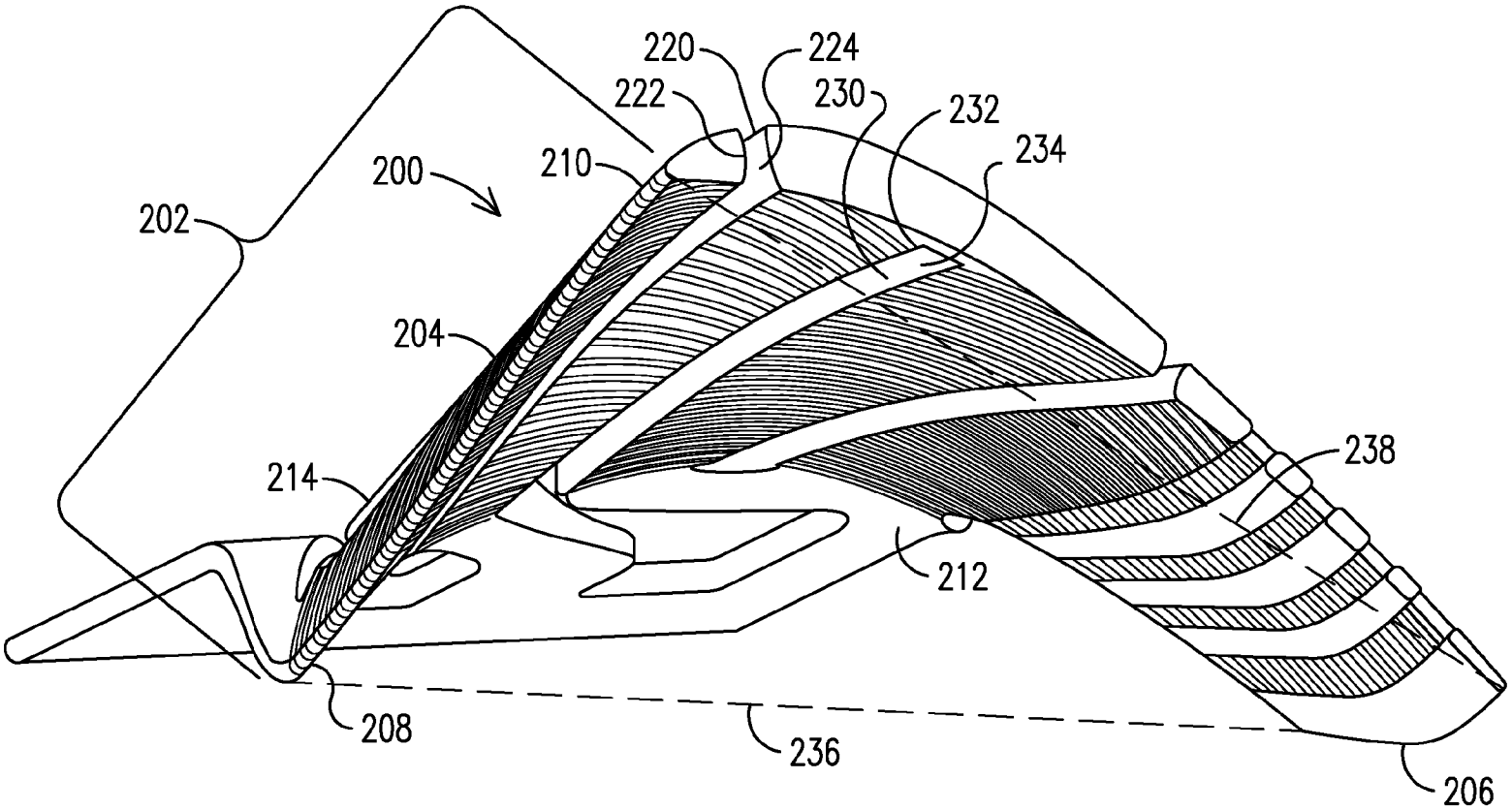
FIG. 9 is a perspective view of a casting core for casting twisted webs in a twisted airfoil.

An exemplary embodiment of a casting core 200 that may be used to create the twisted first rib 130 and second rib 134 is shown in FIG. 9. The casting core 200 has an airfoil portion 202 that includes a leading edge 204, a trailing edge 206, an airfoil base end 208, an airfoil tip end 210, a pressure side exterior surface 212, and a suction side exterior surface 214. Within the casting core 200 is a first void 220 defined by a first leading edge surface 222 and a first trailing edge surface 224. Also present is a second void 230 defined by a second leading edge surface 232 and a second trailing edge surface 234. There may be one void, or several voids, depending on the design. It can be seen that a radially inward chord line 236 and a radially outward chord line 238 are not parallel and thus the airfoil portion 202 twists from the airfoil base end 208 to the airfoil tip end 210. The twist of the casting core 200 is associated with a twist of the airfoil, but the two may or may not be the same, depending on the interior design of the airfoil 24.

Figure 10:
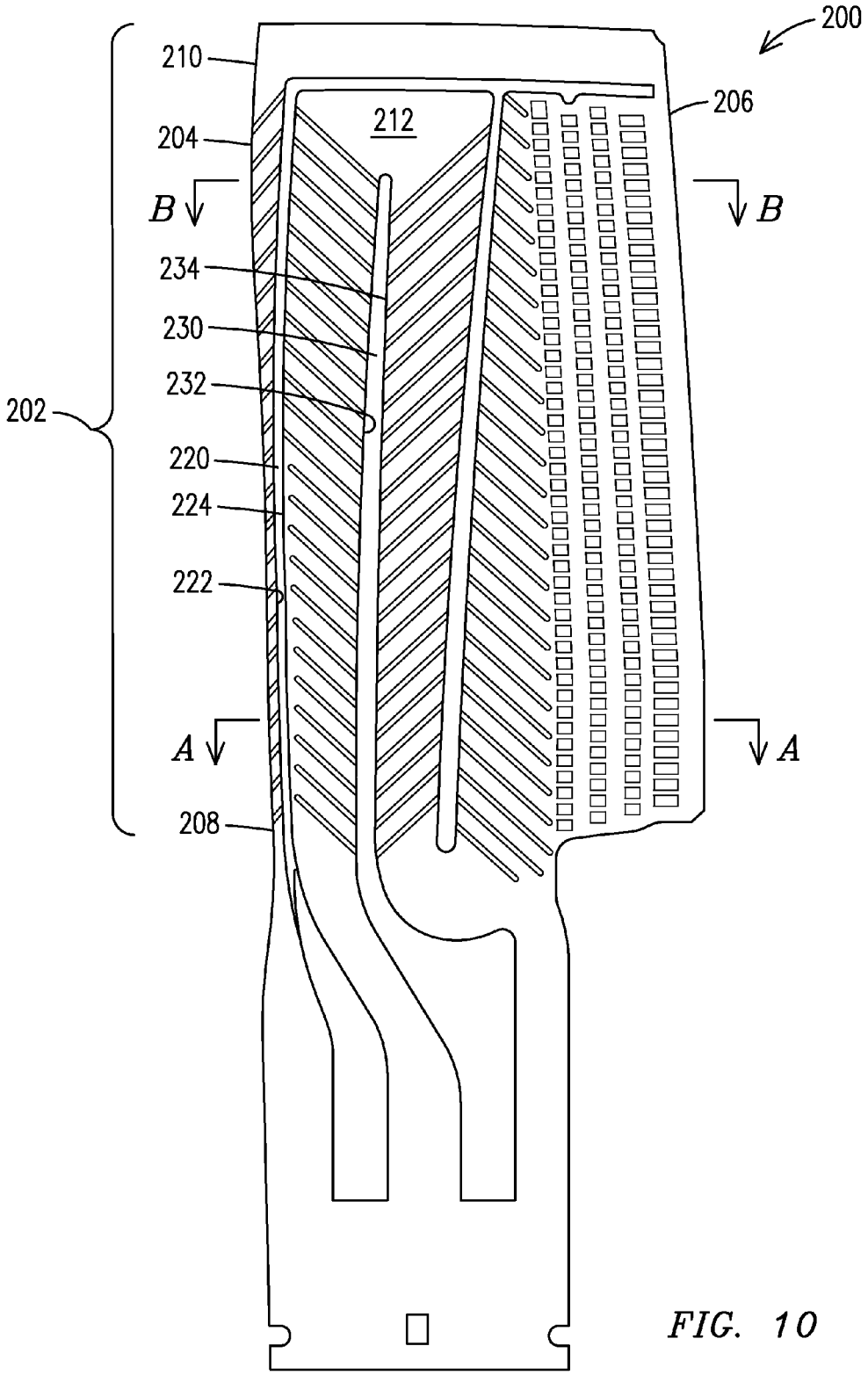
FIG. 10 is a side view of the casting core of FIG. 9.
Figure 11:
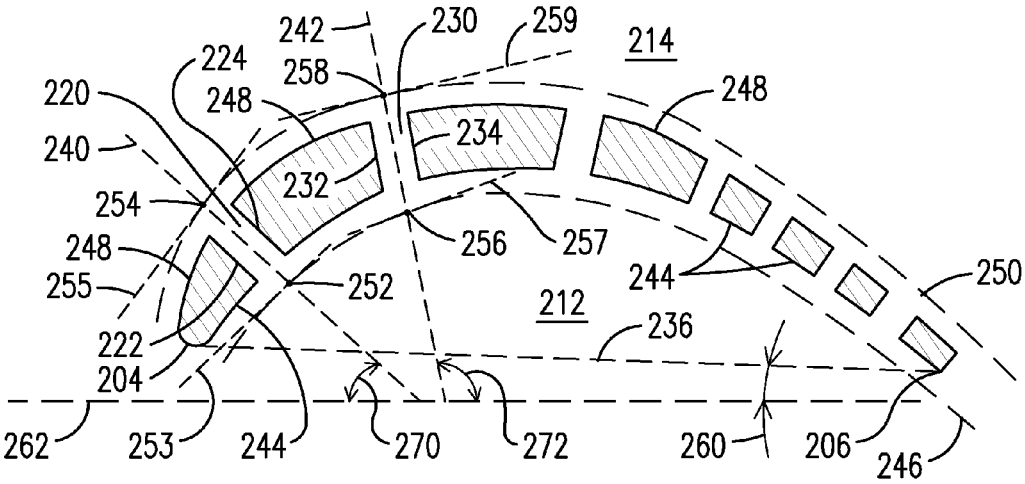

FIG. 10 is a side view of the casting core 200 of FIG. 9 showing the first void 220 defined by the first leading edge surface 222 and the first trailing edge surface 224, and the second void 230 defined by the second leading edge surface 232 and the second trailing edge surface 234. FIG. 11 is a cross section taken along line A-A of FIG. 10, looking radially inward, again showing first void 220, the first leading edge surface 222, the first trailing edge surface 224, the second void 230, the second leading edge surface 232, and the second trailing edge surface 234. The first void 220 defines a first longitudinal axis 240 that spans the airfoil portion 202 from the pressure side exterior surface 212 to the suction side exterior surface 214, and is an elongated extent of the first void 220 that will generally bisect the first void 220. The second void 230 defines a second longitudinal axis 242 that spans the airfoil portion 202 from the pressure side exterior surface 212 to the suction side exterior surface 214, and is an elongated extent of the second void 230 that will generally bisect the second void 230.

The pressure side exterior surfaces 244 of the casting core 200 define a pressure side exterior surface curvature 246, which is a curve that follows a contour defined by the pressure side exterior surfaces 244, and which spans the first void 220 and the second void 230 as though they didn't exist, thereby forming a continuous pressure side exterior surface curvature 246. Likewise, suction side exterior surfaces 248 define a suction side exterior surface curvature 250, which is a curve that follows a contour defined by the suction side exterior surfaces 248, and which spans the first void 220 and the second void 230 as though they didn't exist, thereby forming a continuous suction side exterior surface curvature 250.

The first longitudinal axis 240 intersects the pressure side exterior surface curvature 246 at a first pressure side intersection point 252. The first longitudinal axis 240 intersects a tangent line 253 of the pressure side curvature line 246, taken at the first pressure side intersection point 252, at right angles, or within 10 degrees of being at right angles. The first longitudinal axis 240 intersects the suction side exterior surfaces 248 at a first suction side intersection point 254. The first longitudinal axis 240 intersects a tangent line 255 of the suction side exterior surfaces 248, taken at the first suction side intersection point 254, at right angles, or within 10 degrees of being at right angles.

Similarly, the second longitudinal axis 242 intersects the pressure side exterior surface curvature 246 at a second pressure side intersection point 256. The second longitudinal axis 242 intersects a tangent line 257 of the pressure side curvature line 246, taken at the second pressure side intersection point 256, at right angles, or within 10 degrees of being at right angles. The second longitudinal axis 242 intersects the suction side exterior surfaces 248 at a second suction side intersection point 258. The second longitudinal axis 242 intersects a tangent line 259 of the suction side exterior surfaces 248, taken at the second suction side intersection point 258, at right angles, or within 10 degrees of being at right angles.

Figure 12:
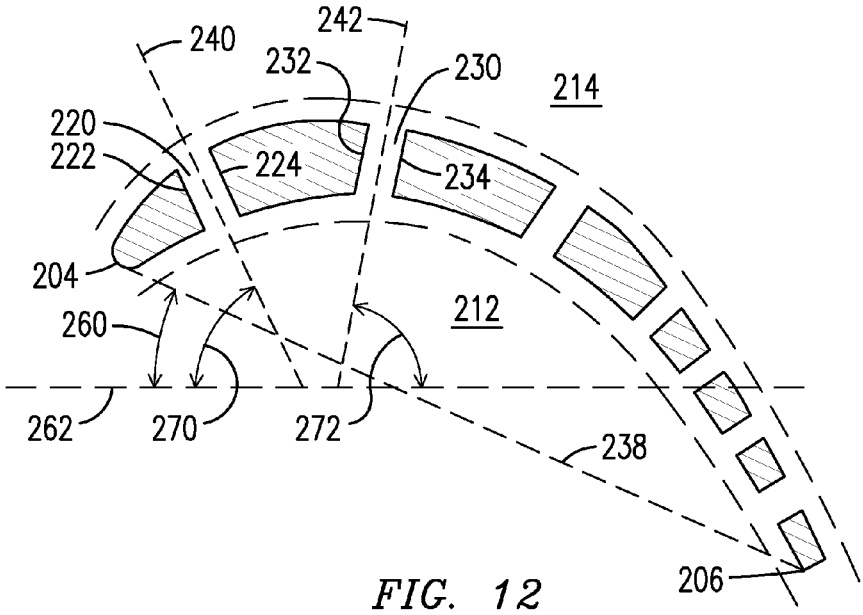
FIGS. 11-12 show cross sections of the casting core of FIG. 10.

A radially inward chord line 236 forms a chord line angle 260 with a reference line 262, which is a line that retains its absolute orientation in both FIG. 11 and FIG. 12. In FIG. 12 it is apparent that the chord line angle 260 formed between the radially outward chord line 238 and the reference line 262 is different than in FIG. 11 and thus the airfoil portion 202 twists from the airfoil base end 208 to the airfoil tip end 210. The first longitudinal axis 240 forms a first angle 270 with the reference line 262. The first angle 270 in FIG. 11 is different than the first angle 270 in FIG. 12, and thus the first void twists from the airfoil base end 208 to the airfoil tip end 210. This can also be seen simply by the fact that the first longitudinal axis 240 in FIG. 11 is not parallel to the first longitudinal axis 240 in FIG. 12. Stated another way, the first longitudinal axis 240 in FIG. 11, which can be considered a first reference axis taken at the airfoil base end 208 of the airfoil portion 202, is not parallel to the first longitudinal axis 240 in FIG. 12.

Since the first longitudinal axis 240 is dependent on a shape and orientation of the first void 220, and the first void 220 is defined by the first leading edge surface 222 and the first trailing edge surface 224, it necessarily follows that the first leading edge surface 222 and the first trailing edge surface 224 also twist from the airfoil base end 208 to the airfoil tip end 210. This is the case regardless of a cross sectional shape the first leading edge surface 222 and the first trailing edge surface 224 take, from straight, to rounded etc. Similar to the twist of the ribs, the twist of the voids may occur in fewer than every cross section. Hence, the twist may occur in some, or all, of the span from the airfoil base end 208 to the airfoil tip end 210.

Similar to the first void 220, in the second void 230, the second longitudinal axis 242 forms a second angle 272 with the reference line 262. The second angle 272 in FIG. 11 is different than the second angle 272 in FIG. 12, and thus the second void 230 twists from the airfoil base end 208 to the airfoil tip end 210. This can also be seen simply by the fact that the second longitudinal axis 242 in FIG. 11 is not parallel to the second longitudinal axis 242 in FIG. 12. Stated another way, the second longitudinal axis 242 of FIG. 11, which can be considered a second reference axis taken at the airfoil base end 208 of the airfoil portion 202, is not parallel to the second longitudinal axis 242 in FIG. 12. It necessarily follows that the second leading edge surface 232 and the second trailing edge surface 234 twist from the airfoil base end 208 to the airfoil tip end 210, regardless of their particular cross sectional shape.

Accordingly, it has been shown that the inventor has devised an innovative gas turbine engine airfoil design that incorporates structural ribs that twist in a radial direction. This twist enables the blade to better withstand forces encountered during operation, while incorporating ribs that are shorter, and therefore lighter and less expensive, using proven manufacturing techniques that are known to be cost effective and reliable. The monolithic structure eliminates any welds or other joints that might not be as robust as the cast monolith. Consequently, the disclosure herein represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine blade, comprising:

an airfoil comprising a pressure side exterior surface, a pressure side interior surface, a suction side exterior surface, a suction side interior surface, and a first rib spanning between the pressure side interior surface and the suction side interior surface, wherein the first rib defines part of a serpentine cooling channel, wherein the airfoil is twisted from a base end of the airfoil to a tip end of the airfoil, wherein the first rib is twisted from a base end of the first rib to a tip end of the first rib, wherein the first rib comprises a narrowing taper along its entire length between the pressure side interior surface and the suction side interior surface, wherein the taper is effective to increase an angle of intersection between a first rib surface and at least one of the pressure side and suction side interior surfaces in a corner of the serpentine cooling channel defined by the first rib when compared to an untapered rib, and wherein the taper is symmetric about a first longitudinal axis of the first rib, and wherein the pressure side surfaces, the suction side surfaces, and the first rib are cast as a monolith; and a second rib spanning between the pressure side exterior surface and the suction side exterior surface that is twisted from a base end of the second rib to a tip end of the second rib, wherein the second rib comprises a narrowing taper along its entire length between the pressure side interior surface and the suction side interior surface, and the first rib and the second rib taper in an opposite direction than the other.

2. The blade of claim 1, wherein in at least one radial cross section of the airfoil longitudinal axes of the first rib and of the second rib are not parallel.

3. The blade of claim 1, wherein in at least one radial cross section of the airfoil the longitudinal axis of the first rib is within 10 degrees of being perpendicular to at least one of the pressure side exterior surface exterior surface and the suction side exterior surface exterior surface at respective intersection points.

4. The blade of claim 1, wherein for each radial cross section of the airfoil the longitudinal axis of the first rib is within 10 degrees of being perpendicular to at least one of the pressure side exterior surface and the suction side exterior surface at respective intersection points.

5. The blade of claim 1, wherein for each radial cross section of the airfoil the longitudinal axis of the first rib is within 10 degrees of being perpendicular to the pressure side exterior surface and the suction side exterior surface at respective intersection points.

6. The blade of claim 1, wherein in at least one radial cross section of the airfoil a leading edge side of the first rib is not parallel to a trailing edge side of the first rib.

7. A gas turbine engine blade, comprising:

a twisted airfoil comprising a base end, a tip end, a pressure side exterior surface, a pressure side interior surface, a suction side exterior surface, a suction side interior surface, and a first rib spanning between the pressure side interior surface and the suction side interior surface, wherein the first rib defines part of a serpentine cooling channel, wherein the pressure side surfaces, the suction side surfaces, and the first rib are cast as a monolith;

wherein in each radial cross section of the airfoil the first rib defines a first longitudinal axis and comprises a first leading edge side and a first trailing edge side;

wherein for a radial cross section of the airfoil taken at a base end of the first rib the first longitudinal axis defines a first reference axis;

wherein the first leading edge side and the first trailing edge side taper toward each other along an entire length of the first rib between the pressure side interior surface and the suction side interior surface, wherein the taper is symmetric about the first longitudinal axis; and wherein in another radial cross section of the airfoil a respective first longitudinal axis is not parallel to the first reference axis, thereby forming a first angle of intersection with the first reference axis; and a second rib spanning between the pressure side exterior surface and the suction side exterior surface, wherein in each radial cross section of the airfoil the second rib defines a second longitudinal axis and comprises a second leading edge side and a second trailing edge side, wherein for a radial cross section of the airfoil taken at a base end of the second rib the second longitudinal axis defines a second reference axis; and wherein in another radial cross section of the airfoil a respective second longitudinal axis is not parallel to the second reference axis, thereby forming a second angle of intersection with the second reference axis, wherein the first rib and the second rib each comprise narrowing tapers along their entire lengths between the pressure side interior surface and the suction side interior surface, and each tapers in an opposite direction than the other.

8. The blade of claim 7, wherein the first angle varies continuously from the base end to the tip end of the first rib.

9. The blade of claim 7, wherein the first angle varies to follow a twist of the airfoil.

10. The blade of claim 7, wherein in at least one radial cross section of the airfoil the first longitudinal axis is within 10 degrees of being perpendicular to at least one of the pressure side exterior surface and the suction side exterior surface at respective intersection points.

11. The blade of claim 7, wherein the second angle varies to follow a twist of the airfoil.

12. The blade of claim 7, wherein for at least one radial cross section of the airfoil the first longitudinal axis and the second longitudinal axis are not parallel.

13. The blade of claim 7, wherein in at least one radial cross section of the airfoil the second longitudinal axis is within 10 degrees of being perpendicular to at least one of the pressure side exterior surface and the suction side exterior at respective intersection points.

14. A gas turbine engine blade, comprising:

an airfoil comprising a pressure side exterior surface, a pressure side interior surface, a suction side exterior surface, a suction side interior surface, a first rib spanning between the pressure side interior surface and the suction side interior surface and defining a first longitudinal axis, and a second rib spanning between the pressure side interior surface and the suction side interior surface and defining a second longitudinal axis, wherein the first rib and the second rib define part of a serpentine cooling channel, wherein the airfoil is twisted from a base end of the airfoil to a tip end of the airfoil, wherein the first rib is twisted from a base end of the first rib to a tip end of the first rib, wherein the second rib is twisted from a base end of the first rib to a tip end of the second rib, wherein in at least one radial cross section of the airfoil, the first longitudinal axis and the second longitudinal axis are not parallel, wherein at least one of the first rib and the second rib comprises a narrowing taper along its entire length between the pressure side interior surface and the suction side interior surface, wherein the taper narrows symmetrically about a respective longitudinal axis, wherein the respective longitudinal axis is normal to both the pressure side exterior surface and the suction side exterior surface, wherein the pressure side exterior surface, the suction side exterior surface, and the first rib are cast as a monolith, and wherein the first rib and the second rib each comprise narrowing tapers along their entire lengths between the pressure side interior surface and the suction side interior surface, and each tapers in an opposite direction than the other.

15. The blade of claim 14, wherein in each radial cross section of the airfoil the first longitudinal axis and the second longitudinal axis are not parallel.

16. The blade of claim 1, wherein the taper of the first rib narrows toward the suction side interior surface.

* * * * *